US006000468A

United States Patent [19]

Pringle

[11] Patent Number: 6,000,468

[45] Date of Patent: Dec. 14, 1999

[54] METHOD AND APPARATUS FOR THE DOWNHOLE METERING AND CONTROL OF FLUIDS PRODUCED FROM WELLS

[75] Inventor: Ronald E. Pringle, Houston, Tex.

[73] Assignee: Camco International Inc., Houston, Tex.

[21] Appl. No.: 08/905,210

[22] Filed: Aug. 1, 1997

Related U.S. Application Data

[60] Provisional application No. 60/022,920, Aug. 1, 1996.

[51] Int. Cl.[6] ..... E21B 43/12

[52] U.S. Cl. ..... 166/53; 166/66; 166/91.1; 137/101.21

[58] Field of Search ..... 166/53, 66, 91.1, 166/250.01, 250.15, 252.1; 137/101.21

[56] References Cited

U.S. PATENT DOCUMENTS

| | | | |
|---|---|---|---|
| 3,756,076 | 9/1973 | Quichaud et al. . | |
| 4,374,544 | 2/1983 | Westerman et al. | 166/252.4 |
| 4,566,317 | 1/1986 | Shakra . | |
| 4,615,390 | 10/1986 | Lucas et al. | 166/250.01 |
| 4,721,158 | 1/1988 | Merritt et al. | 166/53 X |
| 4,738,779 | 4/1988 | Carroll et al. . | |
| 4,770,243 | 9/1988 | Fouillout et al. . | |
| 4,805,697 | 2/1989 | Fouillout et al. . | |
| 4,900,445 | 2/1990 | Flanigan et al. . | |
| 4,976,872 | 12/1990 | Grey . | |
| 4,983,283 | 1/1991 | Grey . | |
| 5,093,006 | 3/1992 | Kalnins . | |
| 5,296,153 | 3/1994 | Peachey . | |
| 5,404,948 | 4/1995 | Fletcher . | |
| 5,456,837 | 10/1995 | Peachey . | |

FOREIGN PATENT DOCUMENTS

| | | |
|---|---|---|
| 0 069 530 | 1/1983 | European Pat. Off. . |
| 2194574A | 3/1988 | United Kingdom . |
| WO 91/07567 | 5/1991 | WIPO . |
| WO 94/13930 | 6/1994 | WIPO . |
| WO 96/41065 | 12/1996 | WIPO . |
| WO 97/11254 | 3/1997 | WIPO . |
| WO 98/13579 | 4/1998 | WIPO . |

*Primary Examiner*—Roger Schoeppel
*Attorney, Agent, or Firm*—Tobor, Goldstein & Healey, L.L.P.

[57] ABSTRACT

In a broad aspect, the invention is a method and apparatus for the downhole metering and control of fluids injected into a subterranean formation, and includes: a housing sealably connectable to a well tubing; a turbine meter disposed in the housing which provides an indication of flow rate therethrough to a control panel at the surface; and a variable orifice valve means in the housing which alternately permits, prohibits, or throttles fluid flow therethrough. The system has a communication link to the surface, an onboard motor which powers a hydraulic system in the housing that controls the throttling action of the variable orifice valve means, and a system to monitor and report downhole pressure and temperature. The system has the option of reversing the action of the turbine to monitor production from the subterranean formation.

40 Claims, 6 Drawing Sheets

METHOD AND APPARATUS FOR THE DOWNHOLE METERING AND CONTROL OF FLUIDS PRODUCED FROM WELLS

RELATED APPLICATIONS

This application claims the benefit of U. S. Provisional Application No. 60/022,920, filed Aug. 1, 1996.

BACKGROUND OF THE INVENTION

1. Field of the Invention

The present invention relates to subsurface well completion equipment and, more particularly, to methods and related apparatus for the metering and control of fluids that have been separated by downhole apparatus.

2. Description of the Related Art

Commonly, in subterranean oil producing formations, oil and water coexist in varying ratios. The most commercially ideal situation for an oil producing company is to have a well where the percentage of water, commonly referred to as the "water cut" to be as close to zero as is practical, but in reality as oil is produced from the formation, the water cut percentage invariably increases. Water produced with the oil is a problem for operating companies since it must be separated from the oil at the earliest possible point in the oil production process to avoid the costs associated with handling and or transporting and disposing of large volumes of water. This is especially true in wells with a high water cut, wherein the percentage of water is 75% or greater.

In the past, equipment has been used to separate the oil from the water after it has been lifted to the surface. The most basic method is to allow the produced fluid to flow into a large tank for "settling". The difference in density of the two fluids causes a separation to occur. The water is removed from the bottom of the tank and is disposed of, leaving the crude oil for use by the operator. A third product, dissolved gas which breaks out of solution as a result of decreased pressure, must also be managed by the surface equipment. This method is very slow and expensive. Over time, smaller separators were developed that allowed portions of the water cut and gas to be removed from the oil at the surface, but the expense of lifting the water to the surface, and the disposal thereof, still represented a significant expense. In these cases the separated oil is moved to storage tanks until transport by pipeline, truck or tanker is arranged. The water is disposed of, generally by being reinjected into the original formation, or in a disposal well. In the case of high water cut wells, the volume of water handled can be 80 to 90 percent of the total production of the well. The ultimate economics of the well dictate that when the cost of lifting and disposal of water exceed the value of the crude oil being produced, the well must be abandoned, leaving valuable crude oil in the formation.

More recently, methods have been developed to separate the oil from the water downhole, either by filtration, as described in U.S. Pat. No. 4,241,787, or by centrifugal force in devices well known to those skilled in the art called "hydrocyclones". Hydrocyclones positioned deep in the well and used in conjunction with downhole electric submersible pumps (commonly called ESP's) separate the oil and water by taking advantage of the difference in the density of the two fluids. In application, the oil/water mixture is pumped tangentially and rotationally into a cylindrical chamber in the hydrocyclone causing a separation vortex. Centrifugal force in the vortex causes the fluids to separate, with the water passing out the bottom of the hydrocyclone, and the oil passing out the top. The resultant oil portion can be lifted to the surface, while the water portion can be reinjected directly into the formation from whence it was produced, or it can be routed into a disposal stratum. The hydrocyclones can be arranged in a series to increase the efficiency of the device to relatively match the water cut. The advantages of downhole separation of the produced oil/water mixture are obvious. The excess water does not have to lifted to the surface, solution gas remains dissolved in the water and is distributed with the water in the disposal stratum, and the surface separation facilities can be much smaller and less expensive. The end is enhanced economics of the produced well resulting in a greater percentage of oil being recovered from the formation.

In order for downhole hydrocyclones to function optimally, controlled back pressure must be maintained, as small pressure fluctuations on the discharge radically effect the efficiency thereof. When the water cut portion of the produced fluid is not lifted to the surface where it can be directly measured, the operator has no direct indication of the water cut percentage, and how it changes over time. This leads to a decreased ability to manage the reservoir and to monitor the efficiency of the separation hydrocyclones.

There is a need for an apparatus to enhance and optimize the operation of downhole separation hydrocyclones by metering and controlling fluids being reinjected into the formation by: providing a back pressure on the hydrocyclone; controlling the water injection flow rate; monitoring the total volume of fluid injected into the formation; and monitoring temperature, as well as providing an indication of up and downstream pressure on the apparatus. There is also a need for an apparatus to similarly monitor the fluid volume being lifted from the well to the surface.

SUMMARY OF THE INVENTION

The present invention has been contemplated to overcome the foregoing deficiencies and meet the above described needs. In a broad aspect, the invention is a method and apparatus for the downhole metering and control of fluids injected into a subterranean formation, comprising: a housing sealably connectable to a well tubing; a turbine meter disposed in the housing which provides an indication of flow rate of well fluids therethrough; and a variable orifice valve means in the housing which alternately permits, prohibits, or throttles fluid flow therethrough. The system may be controlled by and communicate data collected via a communication conduit from the housing to the surface. The system may contain an onboard motor which powers a hydraulic system in the housing that controls the throttling action of the variable orifice valve means. The invention as described above may contain at least one thermocouple to report downhole temperatures. The invention as described above may contain at least one pressure transducer at locations upstream and/or downstream of the variable orifice valve means. The invention as described above may contain at least one pressure transducer to monitor pressure in the hydraulic control system. The invention as described has the option of reversing the action of the turbine to monitor production from the subterranean formation.

In another aspect, the apparatus of the present invention may include: a housing connectable to a well tubing; a communication conduit connected to the housing for communicating data collected within the apparatus to a control panel at the earth's surface; a turbine meter disposed in the housing for providing an indication through the communication conduit to the control panel of a flow rate of well fluids through the housing; and, a variable orifice valve means in the housing for controlling fluid flow therethrough. Another feature of the present invention is that the communication conduit includes at least one electrical conductor. Another feature of the present invention is that the turbine meter includes a turbine and a revolution counting device, the revolution counting device being connected to the communication conduit for providing an indication to the control panel, based upon the number of revolutions per unit time of the turbine, of flow rate of well fluids through the housing. Another feature of the present invention is that the revolution counting device is a magnetic pickup. Another feature of the present invention is that the present invention may further include at least one pressure transducer connected to the communication conduit to report downhole pressures to the control panel. Another feature of the present invention is that the present invention may further include at least one temperature sensor connected to the communication conduit to report downhole temperatures to the control panel. Another feature of the present invention is that the housing may further include at least one flow port, and fluid flow through the at least one flow port is controlled by the variable orifice valve means. Another feature of the present invention is that the present invention may further include a first pressure transducer located upstream from the at least one flow port, and a second pressure transducer located downstream from the at least one flow port, whereby the first and second pressure transducers cooperate to report a pressure drop across the at least one flow port to the control panel. Another feature of the present invention is that the housing may further include an outer sleeve portion having a plurality of flow area control slots, the outer sleeve portion being disposed about the sleeve and across the flow ports. Another feature of the present invention is that the variable orifice valve means may include a sleeve disposed for axial movement within a longitudinal bore of the housing to control fluid flow through the at least one flow port. Another feature of the present invention is that a lower end of the sleeve may include a stem for cooperating with a valve seat to sealably control fluid flow through the at least one flow port. Another feature of the present invention is that the stem may be a carbide stem. Another feature of the present invention is that the present invention may further include spring means for biasing the sleeve to close the at least one flow port. Another feature of the present invention is that the present invention may further include piston means on the sleeve and in fluid communication with a source of hydraulic fluid for hydraulically controlling fluid flow through the at least one flow port. Another feature of the present invention is that the source of hydraulic fluid may be a hydraulic control line provided in the communication conduit. Another feature of the present invention is that the source of hydraulic fluid may be an on-board hydraulic system connected to the communication link and being controllable from the control panel. Another feature of the present invention is that the on-board hydraulic system may include a motor for driving a pump, the pump directing pressurized fluid to a solenoid valve, the solenoid valve directing the pressurized fluid to the piston means to hydraulically control fluid flow through the at least one flow port. Another feature of the present invention is that the present invention may further include a first internal conduit, a second internal conduit, and a third internal conduit, the pump directing pressurized fluid through the first internal conduit to the solenoid valve, the solenoid valve directing the pressurized fluid through the second internal conduit to act on an upper side of the piston means to move the variable orifice valve means towards its closed position when the solenoid valve is in a first position, and the solenoid valve directing the pressurized fluid through the third internal conduit to act on a lower side of the piston means to move the variable orifice valve means away from its closed position when the solenoid valve is in a second position. Another feature of the present invention is that the solenoid valve may be a shuttle-type solenoid valve. Another feature of the present invention is that the present invention may further include a volume compensator piston to displace the volume of fluid that is utilized as the apparatus operates and to compensate for pressure changes caused by any temperature fluctuations. Another feature of the present invention is that the present invention may further include at least one pressure transducer to report pressure in the hydraulic system to the control panel. Another feature of the present invention is that the present invention may further include position sensor means for providing an indication of the position of the sleeve to the control panel. Another feature of the present invention is that the position sensor means may comprise position sensor rings that enable an operator at the earth's surface to control the flow rate through the apparatus by stopping the sleeve in at least one intermediate position between a full open and a full closed position. Another feature of the present invention is that the present invention may further include a straightener vane disposed within the housing adjacent the position sensor rings. Another feature of the present invention is that the apparatus may be reversible so that it may be used alternatively to monitor production of fluids from a subterranean formation and to monitor fluids injected into the subterranean formation.

In another aspect, the present invention may include: a housing connectable to a well tubing; a communication conduit connected to the housing for communicating data collected within the apparatus to a control panel at the earth's surface; at least one flow port in the housing; a first pressure transducer located upstream from the at least one flow port; a second pressure transducer located downstream from the at least one flow port, the first and second pressure transducers cooperating to report a pressure drop across the at least one flow port to the control panel; and, a variable orifice valve means in the housing for controlling fluid flow through the at least one flow port. Another feature of the present invention is that the communication conduit may include at least one electrical conductor. Another feature of the present invention is that the apparatus may further include a turbine meter disposed in the housing for providing an indication through the communication conduit to the control panel of a flow rate of well fluids through the housing. Another feature of the present invention is that the turbine meter may include a turbine and a revolution counting device, the revolution counting device being connected to the communication conduit for providing an indication to the control panel, based upon the number of revolutions per unit time of the turbine, of flow rate of well fluids through the housing. Another feature of this aspect of the present invention is that the revolution counting device may be a magnetic pickup. Another feature of this aspect of the present invention is that the apparatus may further include at least one temperature sensor connected to the communication conduit to report downhole temperatures to the control panel. Another feature of the present invention is that the housing may further include an outer sleeve portion having a plurality of flow area control slots, the outer sleeve portion being disposed about the sleeve and across the flow ports. Another feature of the present invention is that the variable orifice valve means may include a sleeve disposed for axial movement within a longitudinal bore of the housing to control fluid through the at least one flow port. Another feature of the present invention is that a lower end of the sleeve may include a stem for cooperating with a valve seat to sealably control fluid flow through the at least one flow port. Another feature of the present invention is that the stem may be a carbide stem. Another feature of the present invention is that the apparatus may further include spring means for biasing the sleeve to close the at least one flow port. Another feature of the present invention is that the apparatus may further include piston means on the sleeve and in fluid communication with a source of hydraulic fluid for hydraulically controlling fluid flow through the at least one flow port. Another feature of the present invention is that the source of hydraulic fluid may be a hydraulic control line provided in the communication conduit. Another feature of the present invention is that the source of hydraulic fluid may be an on-board hydraulic system connected to the communication link and being controllable from the control panel. Another feature of the present invention is that the on-board hydraulic system may include a motor for driving a pump, the pump directing pressurized fluid to a solenoid valve, the solenoid valve directing the pressurized fluid to the piston means to hydraulically control fluid flow through the at least one flow port. Another feature of the present invention is that the apparatus may further include a first internal conduit, a second internal conduit, and a third internal conduit, the pump directing pressurized fluid through the first internal conduit to the solenoid valve, the solenoid valve directing the pressurized fluid through the second internal conduit to act on an upper side of the piston means to move the variable orifice valve means towards its closed position when the solenoid valve is in a first position, and the solenoid valve directing the pressurized fluid through the third internal conduit to act on a lower side of the piston means to move the variable orifice valve means away from its closed position when the solenoid valve is in a second position. Another feature of the present invention is that the solenoid valve may be a shuttle-type solenoid valve. Another feature of the present invention is that the apparatus may further include a volume compensator piston to displace the volume of fluid that is utilized as the apparatus operates and to compensate for pressure changes caused by any temperature fluctuations. Another feature of this aspect of the present invention is that the apparatus may further include at least one pressure transducer to report pressure in the hydraulic system to the control panel. Another feature of this aspect of the present invention is that the apparatus may further include position sensor means for providing an indication of the position of the sleeve to the control panel. Another feature of this aspect of the present invention is that the position sensor means may comprise position sensor rings that enable an operator at the earth's surface to control the flow rate through the apparatus by stopping the sleeve in at least one intermediate position between a full open and a full closed position. Another feature of this aspect of the present invention is that the apparatus may further include a straightener vane disposed within the housing adjacent the position sensor rings. Another feature of this aspect of the present invention is that the apparatus may be reversible so that it may be used alternatively to monitor production of fluids from a subterranean formation and to monitor fluids injected into the subterranean formation.

In another aspect, the present invention may include: a housing connectable to a well tubing; a communication conduit connected to the housing for communicating data collected within the apparatus to a control panel at the earth's surface; and, a variable orifice valve means in the housing for controlling fluid flow therethrough. Another feature of this aspect of the present invention is that the apparatus may further include a turbine meter disposed in the housing for providing an indication through the communication conduit to the control panel of a flow rate of well fluids through the housing. Another feature of this aspect of the present invention is that the turbine meter may include a turbine and a revolution counting device, the revolution counting device being connected to the communication conduit for providing an indication to the control panel, based upon the number of revolutions per unit time of the turbine, of flow rate of well fluids through the housing. Another feature of this aspect of the present invention is that the revolution counting device may be a magnetic pickup. Another feature of this aspect of the present invention is that the housing may further include at least one flow port, and fluid flow through the at least one flow port is controlled by the variable orifice valve means. Another feature of this aspect of the present invention is that the apparatus may further include a first pressure transducer located upstream from the at least one flow port, and a second pressure transducer located downstream from the at least one flow port, whereby the first and second pressure transducers cooperate to report a pressure drop across the at least one flow port to the control panel. Another feature of this aspect of the present invention is that the apparatus may further include at least one temperature sensor connected to the communication conduit to report downhole temperatures to the control panel. Another feature of this aspect of the present invention is that the communication conduit may include at least one electrical conductor. Another feature of this aspect of the present invention is that the apparatus may be reversible so that it may be used alternatively to monitor production of fluids from a subterranean formation and to monitor fluids injected into the subterranean formation.

In another aspect, the present invention may be a downhole system to dewater raw crude including: an electric submersible pump in fluid communication with the raw crude; a first hydrocyclone in fluid communication with the pump; a second hydrocyclone in fluid communication with the first hydrocyclone; and at least one downhole metering and control device having a housing connectable to a well tubing, a communication conduit connected to the housing for communicating data collected within the apparatus to a control panel at the earth's surface, and a variable orifice valve means in the housing for controlling fluid flow therethrough, the downhole metering and control device being in fluid communication with the first hydrocyclone; whereby the raw crude is drawn through the electric submersible pump and is directed under pressure to the first hydrocyclone where a first stage of water/oil separation occurs to create first stage effluent water and first stage dewatered oil, the first stage effluent water is discharged from the first hydrocyclone and injected through the at least one downhole metering and control device and into a disposal stratum, the first stage dewatered oil is directed through the second hydrocyclone where a second stage of water/oil separation occurs to create second stage effluent water and second stage dewatered oil, the second stage dewatered oil is lifted to the earth's surface, and the second stage effluent water is directed to the pump to be reprocessed. Another feature of this aspect of the present invention is that the apparatus may further include a second downhole metering and control device in fluid communication with the second hydrocyclone and with the earth's surface, whereby the second stage dewatered oil is passed through the second downhole metering and control device before being lifted to the earth's surface.

In another aspect, the present invention may be a downhole system to dewater raw crude including: an electric submersible pump in fluid communication with the raw crude; a first hydrocyclone in fluid communication with the pump; a second hydrocyclone in fluid communication with the first hydrocyclone; and, at least one downhole metering and control device having a housing connectable to a well tubing, a communication conduit connected to the housing for communicating data collected within the apparatus to a control panel at the earth's surface, and a variable orifice valve means in the housing for controlling fluid flow therethrough, the downhole metering and control device being in fluid communication with the second hydrocyclone; and whereby the raw crude is drawn through the electric submersible pump and is directed under pressure to the first hydrocyclone where a first stage of water/oil separation occurs to create first stage effluent water and first stage dewatered oil, the first stage dewatered oil is lifted to the earth's surface, the first stage effluent water is directed through the second hydrocyclone where a second stage of water/oil separation occurs to create second stage effluent water and second stage dewatered oil, the second stage effluent water is discharged from the second hydrocyclone and injected through the at least one downhole metering and control device and into a disposal stratum, the second stage dewatered oil is directed to the pump to be reprocessed. Another feature of this aspect of the present invention is that the system may further include at least one additional downhole metering and control device. Another feature of this aspect of the present invention is that the at least one additional downhole metering and control device may be in fluid communication with the first hydrocyclone and with the earth's surface, whereby the first stage dewatered oil is passed through the at least one additional downhole metering and control device before being lifted to the earth's surface. Another feature of this aspect of the present invention is that the at least one additional downhole metering and control device may be in fluid communication with the second hydrocyclone and with the pump, whereby the second stage dewatered oil is passed through the at least one additional downhole metering and control device before being reprocessed through the pump. Another feature of this aspect of the present invention is that the at least one additional downhole metering and control device may be in fluid communication with the at least one downhole metering and control device, and may further include a second electric submersible pump, the second pump being in fluid communication with the at least one downhole metering and control device, the at least one additional downhole metering and control device, and the second hydrocyclone, whereby at least a portion of the second stage effluent water exiting the at least one downhole metering and control device is directed through the second pump from where it is directed back through the second hydrocyclone for more efficient deoiling, and the remainder of the second stage effluent water exiting the at least one downhole metering and control device is injected through the at least one additional downhole metering and control device into the disposal stratum. Another feature of this aspect of the present invention is that the at least one additional downhole metering and control device may be in fluid communication with the at least one downhole metering and control device and the pump, whereby at least a portion of the second stage effluent water exiting the at least one downhole metering and control device may be directed back to the pump to be reprocessed for more efficient deoiling, and the remainder of the second stage effluent water exiting the at least one downhole metering and control device may be injected through the at least one additional downhole metering and control device into the disposal stratum.

In another aspect, the present invention may be a downhole system to dewater raw crude including: an electric submersible pump in fluid communication with the raw crude; a hydrocyclone in fluid communication with the pump; and, at least one downhole metering and control device having a housing connectable to a well tubing, a communication conduit connected to the housing for communicating data collected within the apparatus to a control panel at the earth's surface, and a variable orifice valve means in the housing for controlling fluid flow therethrough, the downhole metering and control device being in fluid communication with the first hydrocyclone; whereby the raw crude is drawn through the electric submersible pump and is directed under pressure to the hydrocyclone where a stage of water/oil separation occurs to create effluent water and dewatered oil, the effluent water is discharged from the hydrocyclone and injected through the at least one downhole metering and control device and into a disposal stratum, and the dewatered oil is lifted to the earth's surface. Another feature of this aspect of the present invention is that the system may further include a second downhole metering and control device in fluid communication with the hydrocyclone and with the earth's surface, whereby the dewatered oil is passed through the second downhole metering and control device before being lifted to the earth's surface.

In another aspect, the present invention may be a downhole method of dewatering raw crude including the steps of: using an electric submersible pump to direct the raw crude under pressure to a first hydrocyclone where a first stage of water/oil separation occurs to create first stage effluent water and first stage dewatered oil; discharging the first stage effluent water from the first hydrocyclone and injecting it through a first downhole metering and control device and into a disposal stratum, the first downhole metering and control device having a housing connectable to a well tubing, a communication conduit connected to the housing for communicating data collected within the apparatus to a control panel at the earth's surface, and a variable orifice valve means in the housing for controlling fluid flow therethrough; directing the first stage dewatered oil through a second hydrocyclone where a second stage of water/oil separation occurs to create second stage effluent water and second stage dewatered oil; lifting the second stage dewatered oil to the earth's surface; and, directing the second stage effluent water to the pump to be reprocessed. Another feature of this aspect of the present invention is that the method may further include the step of passing the second stage dewatered oil through a second downhole metering and control device before being lifted to the earth's surface.

In another aspect, the present invention may be a downhole method of dewatering raw crude including the steps of: using an electric submersible pump to direct the raw crude under pressure to a first hydrocyclone where a first stage of water/oil separation occurs to create first stage effluent water and first stage dewatered oil; lifting the first stage dewatered oil to the earth's surface; directing the first stage effluent water through a second hydrocyclone where a second stage of water/oil separation occurs to create second stage effluent water and second stage dewatered oil; discharging the second stage effluent water from the second hydrocyclone and injecting it through a first downhole metering and control device and into a disposal stratum, the first downhole metering and control device having a housing connectable to a well tubing, a communication conduit connected to the housing for communicating data collected within the apparatus to a control panel at the earth's surface, and a variable orifice valve means in the housing for controlling fluid flow therethrough; and, directing the second stage dewatered oil to the pump to be reprocessed. Another feature of this aspect of the present invention is that the method may further include the step of passing the first stage dewatered oil through a second downhole metering and control device before being lifted to the earth's surface. Another feature of this aspect of the present invention is that the method may further include the step of passing the second stage dewatered oil through a second downhole metering and control device before being reprocessed through the pump. Another feature of this aspect of the present invention is that the method may further include the steps of passing at least a portion of the second stage effluent water exiting the first downhole metering and control device through a second electric submersible pump and back through the second hydrocyclone for more efficient deoiling, and injecting the remainder of the second stage effluent water exiting the first downhole metering and control device through a second downhole metering and control device into the disposal stratum. Another feature of this aspect of the present invention is that the method may further include the steps of passing at least a portion of the second stage effluent water exiting the first downhole metering and control device back to the pump to be reprocessed for more efficient deoiling, and injecting the remainder of the second stage effluent water exiting the first downhole metering and control device through a second downhole metering and control device into the disposal stratum.

In another aspect, the present invention may be a downhole method of dewatering raw crude including the steps of: using an electric submersible pump to direct the raw crude under pressure to a hydrocyclone where a stage of water/oil separation occurs to create effluent water and dewatered oil; discharging the effluent water from the hydrocyclone and injecting it through a first downhole metering and control device and into a disposal stratum, the first downhole metering and control device having a housing connectable to a well tubing, a communication conduit connected to the housing for communicating data collected within the apparatus to a control panel at the earth's surface, and a variable orifice valve means in the housing for controlling fluid flow therethrough; and, lifting the dewatered oil to the earth's surface. Another feature of this aspect of the present invention is that the method may further include the step of passing the dewatered oil through a second downhole metering and control device before being lifted to the earth's surface.

Figure 1A:
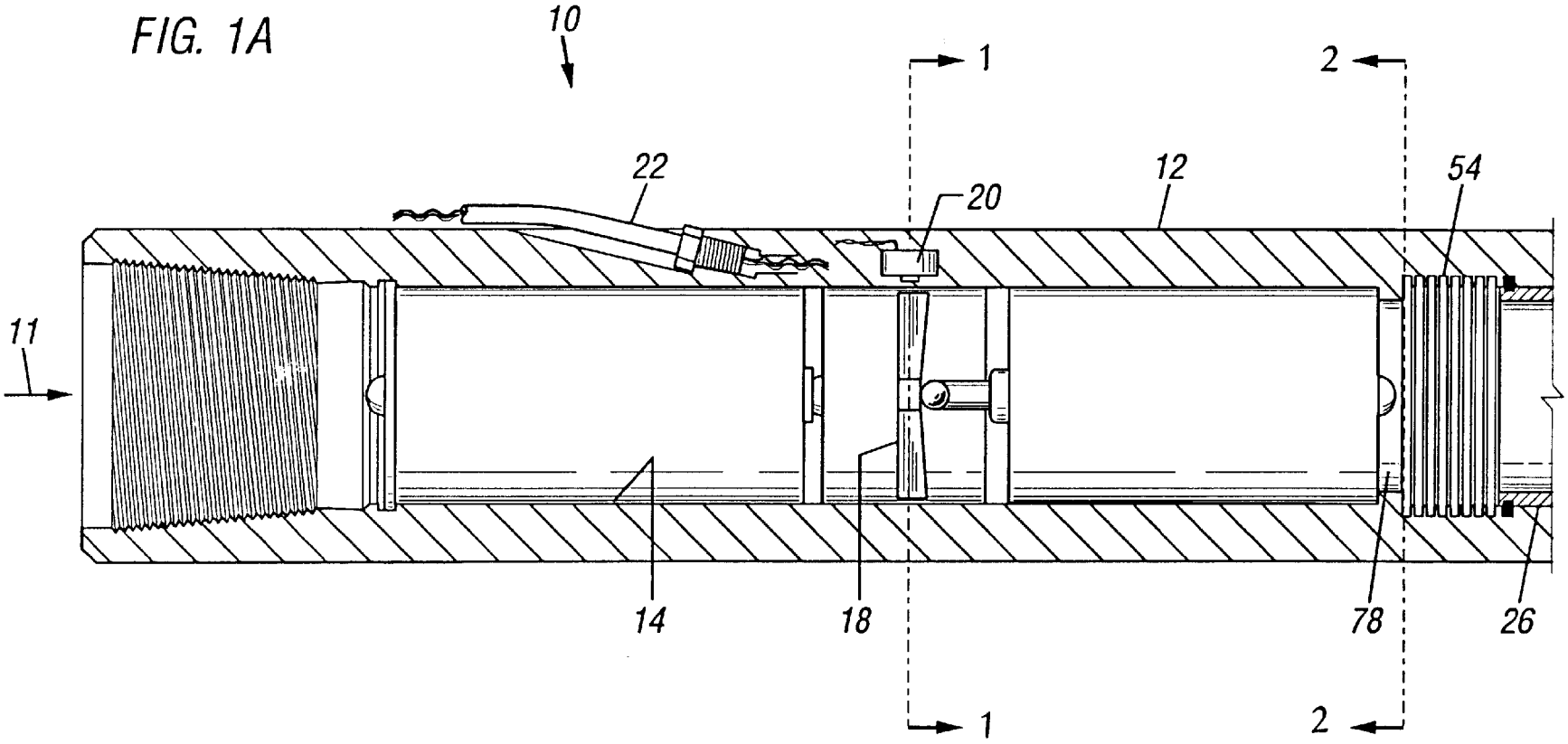
FIGS. 1A–1C illustrate a longitudinal cross-sectional view of the present invention.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

Detailed Description of the Invention

In the description which follows, like parts are marked throughout the specification and drawings with the same reference numerals, respectively. The figures are not necessarily drawn to scale, and in some instances, have been exaggerated or simplified to clarify certain features of the invention. One skilled in the art will appreciate many differing applications of the described apparatus.

For the purposes of this discussion, the terms "upper" and "lower", "up hole" and "downhole", and "upwardly" and "downwardly" are relative terms to indicate position and direction of movement in easily recognized terms. Usually, these terms are relative to a line drawn from an upmost position at the surface to a point at the center of the earth, and would be appropriate for use in relatively straight, vertical wellbores. However, when the wellbore is highly deviated, such as from about 60 degrees from vertical, or horizontal these terms do not make sense and therefore should not be taken as limitations. These terms are only used for ease of understanding as an indication of what the position or movement would be if taken within a vertical wellbore.

Figure 1B:
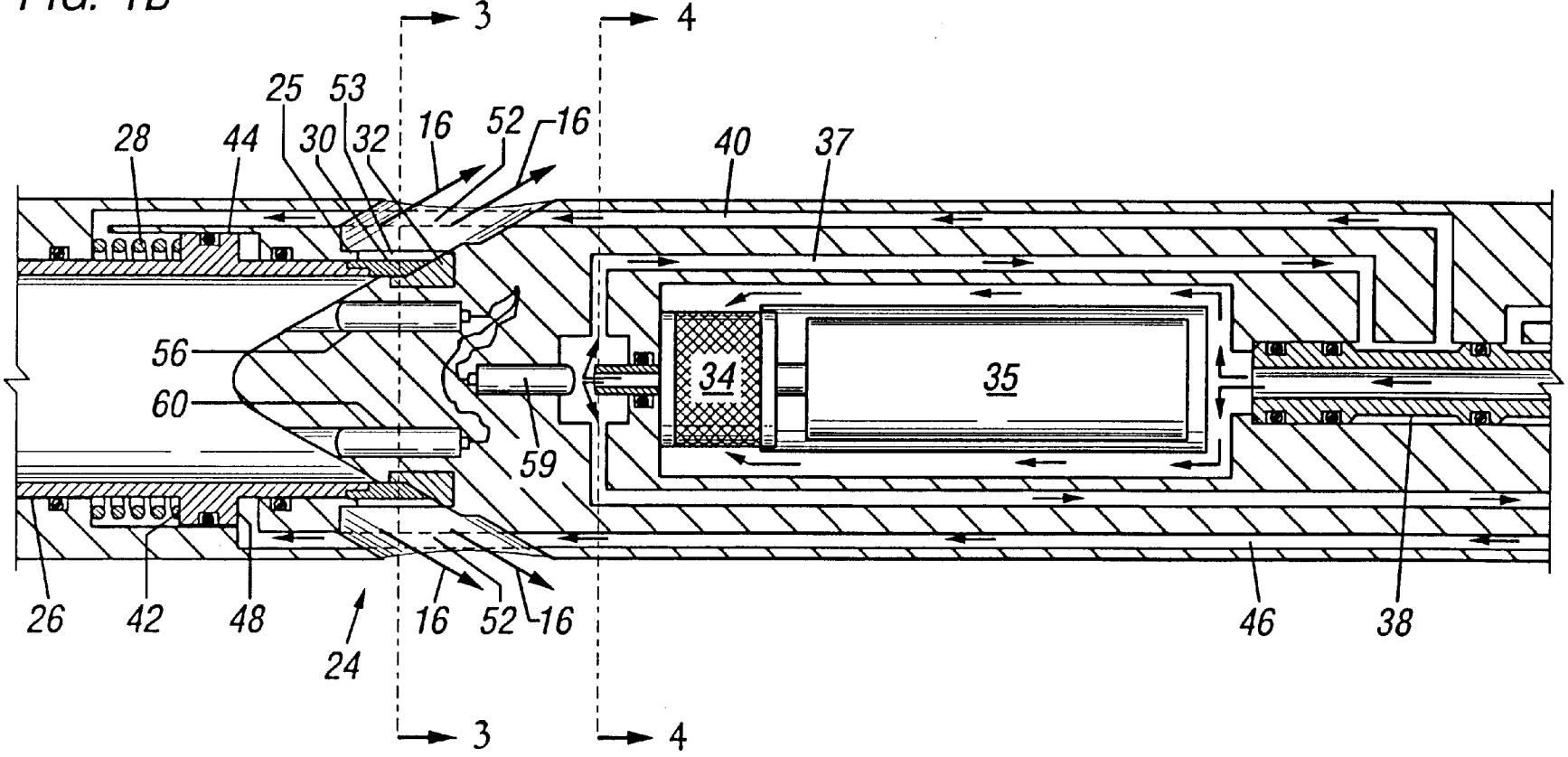
Figure 1C:
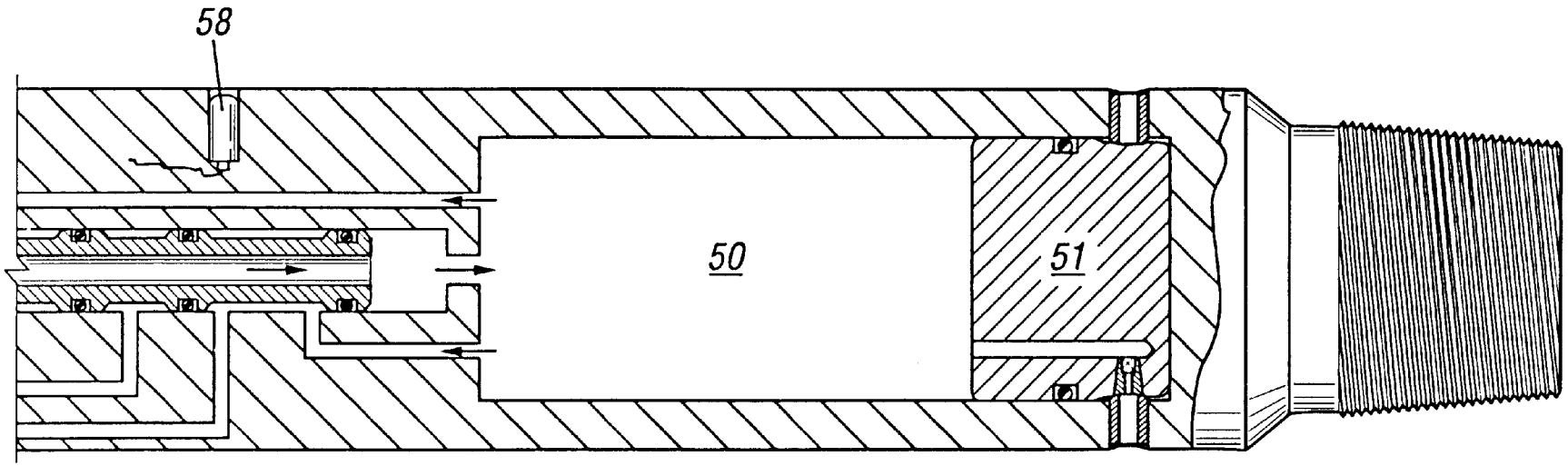
Figure 1E:
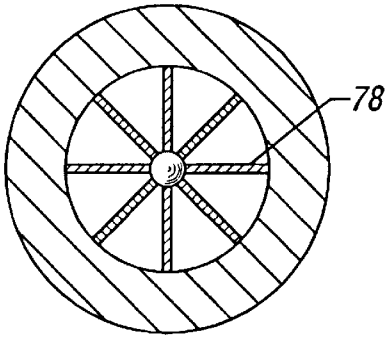
FIG. 1E is a cross-sectional view taken along line 2—2 of FIG. 1A.
Figure 1G:
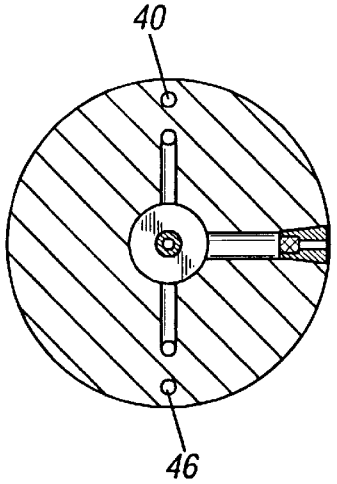
FIG. 1G is a cross-sectional view taken along line 4—4 of FIG. 1B.
Figure 1D:
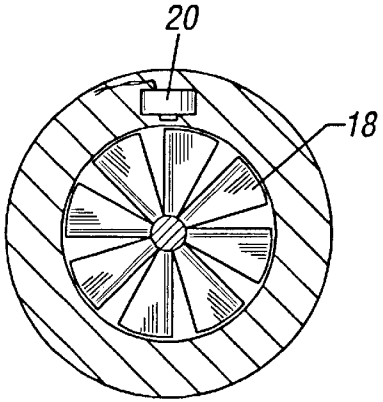
FIG. 1D is a cross-sectional view taken along line 1—1 of FIG. 1A.

Referring now to FIGS. 1A–1C, the apparatus for downhole metering and control of fluids of the present invention 10 comprises a generally cylindrical housing 12, with a longitudinal bore 14 therethrough. Flow of fluid into the apparatus 10 is represented by flow arrows 11. Flow rate through the device is measured by a turbine 18 mounted inside the housing 12. A magnetic pickup 20 counts the rotations of the turbine 18, and transmits this data to a surface control panel (not shown) via a conduit 22 connected to the housing 12. A calibration of the number of turbine 18 rotations per time unit gives an indication to the operator at the surface of the fluid flow rate therethrough. The turbine 18 and magnetic pickup 20 are also shown in FIG. 1D, which is a cross-sectional view taken along line D—D of FIG. 1A.

Figure 1F:
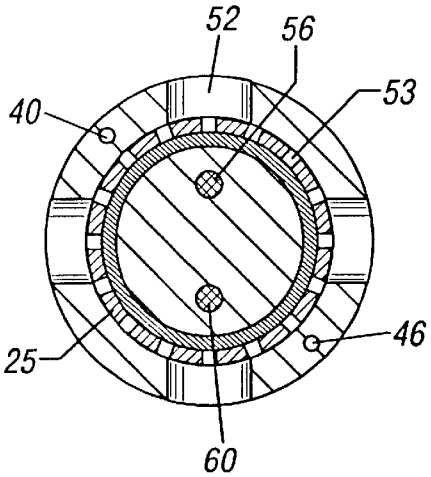
FIG. 1F is a cross-sectional view taken along line 3—3 of FIG. 1B.

Referring now to FIG. 1B, a variable orifice valve is generally denoted as item 24, and is configured in this embodiment as a poppet type valve mechanism, whereby a sleeve 26 may be axially translated between open, closed, and various intermediate positions. One skilled in the art will appreciate many well known and differing closure mechanisms that may be employed, i.e. rotating ball, plugs, flappers or gates. The moveable sleeve depicted herein is for illustration in this embodiment and should not be taken as a limitation. The sleeve 26 is biased normally closed by a coil spring 28, which acts on the sleeve 26. The valve seal is accomplished by a carbide stem 30 in sealable contact with a seat 32. One skilled in the art will immediately recognize that the variable orifice valve as shown in FIGS. 1A–1C is in the closed position, prohibiting flow of fluid therethrough. To assure that the orifice valve stays closed, a pump 34 driven by a motor 35 directs pressurized fluid 36 through a first internal conduit 37 to a shuttle type solenoid valve 38. When the solenoid valve is in a first position, as shown in FIGS. 1B and 1C, the solenoid valve 38 directs fluid through a second internal conduit 40 (see FIG. 1B). The pressurized fluid 36 acts on the upper side 42 of an annular piston 44 which serves to increase the force exerted by the stem 30 on the seat 32, thereby assuring closure of the variable orifice valve. Opening the valve requires a signal to move the solenoid valve 38 axially downward to a second position (not shown). This motion causes a realignment of ports on the solenoid valve 38 which enables pressurized fluid 36 to be directed to a third internal conduit 46 to the lower side 48 of the annular piston 44, as well as releasing the pressure acting on the upper side 42 to a hydraulic fluid reservoir 50. This pressure differential acting upward on the stem 30 causes it to rise off seat, thereby permitting fluid to flow from inside the cylindrical housing 12 through a set of flow ports 52, and be injected into the disposal stratum (not shown). Flow of water to be reinjected into a disposal stratum (not shown) is represented by flow arrows 16, when the device is used in the injection configuration. In a specific embodiment, as shown in FIGS. 1B and 1F, the housing 12 may be provided with an outer sleeve portion 25 having a plurality of flow area control slots 53 and being disposed about the sleeve 26 and across the flow ports 52. The flow area control slots 53 operate to restrict the flow of fluid from inside the housing 12 through the flow ports 52 and to thereby give the operate at the earth's surface greater control over the flow of fluids through the flow ports 52.

As shown in FIG. 1C, an axially movable volume compensator piston 51 may be provided to displace the volume of fluid that is utilized as the apparatus 10 of the present invention operates and to compensate for pressure changes caused by temperature fluctuations. In one specific embodiment, hydraulic pressure to be applied to the piston 44 may be generated by the above-described on-board hydraulic system. In another specific embodiment, hydraulic pressure may be supplied from a remote source through a hydraulic conduit (not shown) within the communication conduit 22.

As shown in FIG. 1A, the apparatus 10 of the present invention may also be provided with position sensor rings 54, which indicate the position of the stem 30 relative to either the full open or the full closed positions of the orifice valve 24 to the control panel on the surface. This position indication gives the operator control of the flow rate through the apparatus, by enabling the sleeve 26 to stop in at least one intermediate position, but in most cases a plurality of intermediate positions between the full open and full closed positions will be used. As shown in FIGS. 1A and 1E, the apparatus 10 of the present invention may also be provided with a straightener vane 78. Additionally, a first pressure transducer 56 (FIG. 1B) and a second pressure transducer 58 (FIG. 1C) provide a continual readout of the pressure drop across the flow ports 52, so that the operator on the surface may adjust the pressure drop across the device, by varying the position of the sleeve 26, should that be operationally desirable. A third pressure transducer 59 monitors the internal hydraulic pressure on the heretofore described hydraulic system that operates the variable orifice valve 24. A thermocouple 60 is also provided to indicate fluidic temperature on the control panel at the surface.

Figure 2:
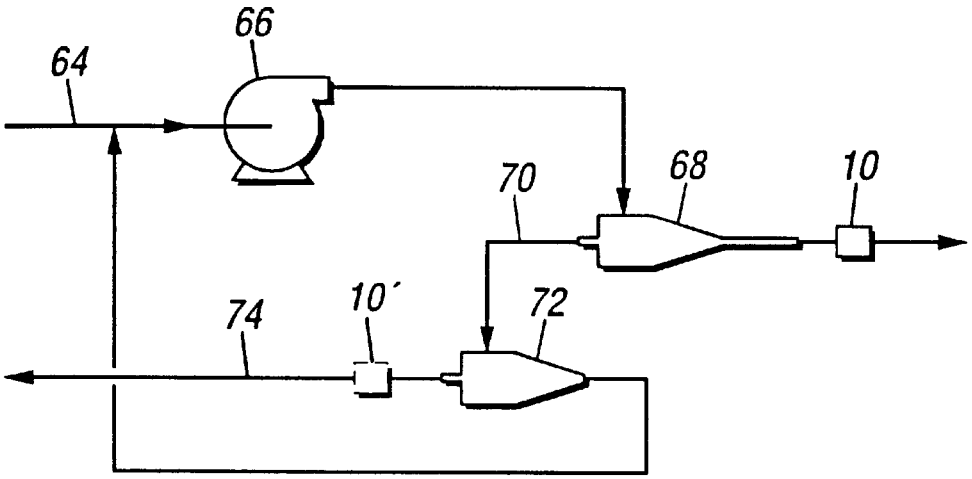
FIG. 2 is a schematic representation of a hydrocyclone system for separating water from crude oil downhole in high water cut applications showing the location of the present invention.

Referring now to FIG. 2, a schematic representation of a possible configuration of a hydrocyclone system to dewater crude in high water cut applications is depicted. Raw production 64 is drawn through an electric submersible pump 66 and is directed under pressure to a first deoiling hydrocyclone 68 where a first stage of water oil separation occurs. The effluent water produced by the first deoiling hydrocyclone 68 is injected through the downhole metering and control device 10 of the present invention and into the disposal stratum. First stage dewatered oil 70 is directed into a second deoiling hydrocyclone 72, where a second stage of water/oil separation occurs. The second stage dewatered oil 74 passes through an optional location for the downhole metering and control device 10' of the present invention, and is lifted to the surface. Effluent from the second deoiling hydrocyclone is routed back to the suction port on the ESP 66 for another process loop deoiling cycle.

Figure 3:
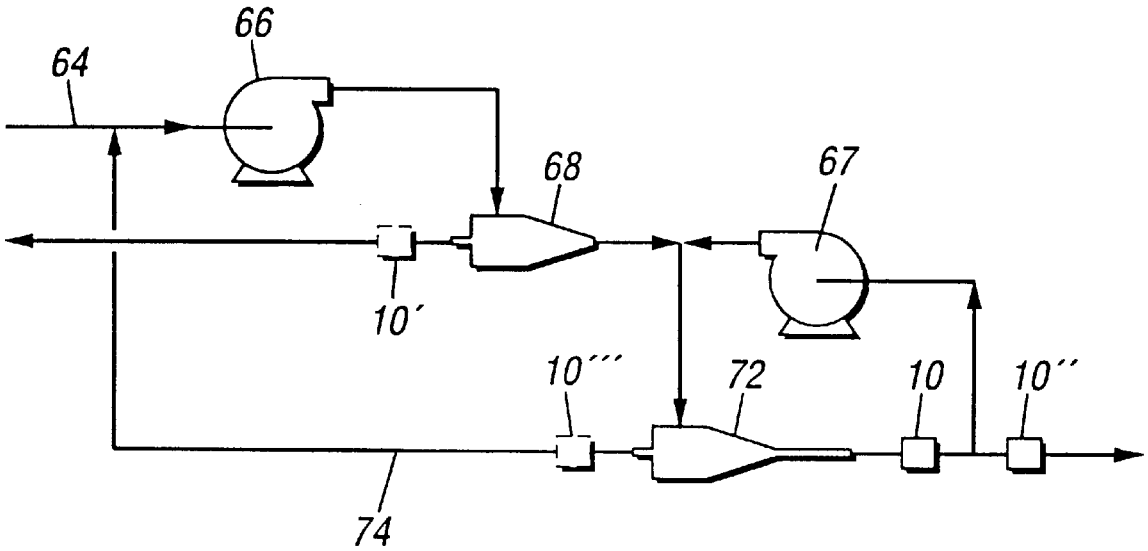
FIG. 3 is a schematic representation of a hydrocyclone system for separating water from crude oil downhole in low water cut applications showing the location of the present invention.

Referring now to FIG. 3, a schematic representation of a possible configuration of a hydrocyclone system to dewater crude in low water cut applications is depicted. Raw production 64 is drawn through an electric submersible pump 66 and is directed under pressure to a first deoiling hydrocyclone 68 where a first stage of water/oil separation occurs. The effluent water produced by the first deoiling hydrocyclone 68 is directed into a second deoiling hydrocyclone 72, where a second stage of water/oil separation occurs while dewatered oil from the first stage hydrocyclone 68 passes through an optional location for the downhole metering and control device 10' of the present invention, and is lifted to the surface. Effluent from the second stage hydrocyclone 72 is passed through the downhole metering and control device 10 of the present invention and is either injected into the disposal stratum, or a portion is directed through a second ESP 67 and is recycled for more efficient deoiling and the remaining portion is passed through an optional location for the downhole metering and control device 10"0 of the present invention and is injected into the disposal stratum. The second stage dewatered oil 74 passes through an optional location for the downhole metering and control device 10'" of the present invention, and is recycled at the suction of the ESP 66.

Figure 4:
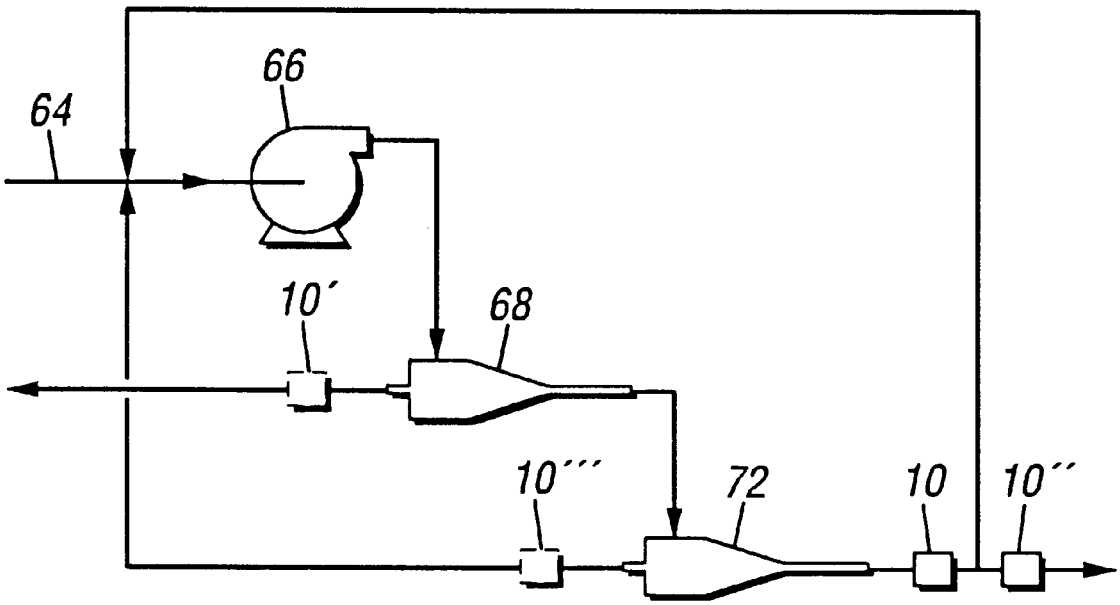
FIG. 4 is a schematic representation of a hydrocyclone system for separating water from crude oil downhole in 50% water cut applications showing the location of the present invention.

Referring now to FIG. 4, a schematic representation of a possible configuration of a hydrocyclone system to dewater crude in 50% water cut applications is depicted. Raw production 64 is drawn through an electric submersible pump 66 and is directed under pressure to a first deoiling hydrocyclone 68 where a first stage of water/oil separation occurs. Dewatered oil is lifted through an optional location for the downhole metering and control device 10' of the present invention, and is lifted to the surface. The effluent water produced by the first deoiling hydrocyclone 68 is directed into a second deoiling hydrocyclone 72, where a second stage of water/oil separation occurs. The second stage dewatered oil 74 passes through an optional location for the downhole metering and control device 10'" of the present invention, and is recycled to the suction port on the ESP 66. Effluent from the second stage hydrocyclone 72 is passed through the downhole metering and control device 10 of the present invention and is either injected into the disposal stratum, or a portion is directed back to the ESP 66 and is recycled for more efficient deoiling and the remaining portion is passed through another optional location for the downhole metering and control device 10" of the present invention and is injected into the disposal stratum.

One skilled in the art of hydrocyclone dewatering will immediately see the value of this invention. An operator at the surface is given an instantaneous real time readout of pressure drop across the downhole metering and control device of the present invention, as well as flow rate total flow volume and temperature. The pressure drop across the device can be adjusted at the surface for more efficient hydrocyclone operation. Use of this device enhances well economics and allows the producing formation to be more completely exploited.

It is to be understood that the invention is not limited to the exact details of construction, operation, exact materials or embodiments shown and described, as obvious modifications and equivalents will be apparent to one skilled in the art. For example, in addition to using the downhole metering and control device 10 of the present invention in combination with hydrocyclone systems to dewater crude oil, the device 10 may also be advantageously used in combination with other downhole well tools to meter and control downhole fluids. Accordingly, the invention is therefore to be limited only by the scope of the appended claims.

I claim:

1. An apparatus for the downhole metering and control of fluids, comprising:

a housing connectable to a well tubing and having a longitudinal bore therethrough and at least one flow port;

a communication conduit connected to the housing for communicating data collected within the apparatus to a control panel at the earth's surface;

a turbine meter disposed in the housing and having a turbine and a revolution counting device, the revolution counting device being connected to the communication conduit for providing an indication to the control panel, based upon the number of revolutions per unit time of the turbine, of flow rate of well fluids through the housing; and, a variable orifice valve disposed within the longitudinal bore and adapted to control fluid flow through the at least one flow port.

2. The downhole fluid metering and control apparatus of claim 1, wherein the communication conduit includes at least one electrical conductor.

3. The downhole fluid metering and control apparatus of claim 1, wherein the revolution counting device is a magnetic pickup.

4. The downhole fluid metering and control apparatus of claim 1, further including at least one pressure transducer connected to the communication conduit to report downhole pressures to the control panel.

5. An apparatus for the downhole metering and control of fluids, comprising:

a housing connectable to a well tubing;

a communication conduit connected to the housing for communicating data collected within the apparatus to a control panel at the earth's surface;

a turbine meter disposed in the housing for providing an indication through the communication conduit to the control panel of a flow rate of well fluids through the housing;

a variable orifice valve in the housing and adapted to control fluid flow therethrough; and at least one temperature sensor connected to the communication conduit to report downhole temperatures to the control panel.

6. An apparatus for the downhole metering and control of fluids, comprising:

a housing connectable to a well tubing and having at least one flow port;

a communication conduit connected to the housing for communicating data collected within the apparatus to a control panel at the earth's surface;

a turbine meter disposed in the housing for providing an indication through the communication conduit to the control panel of a flow rate of well fluids through the housing;

a variable orifice valve disposed for movement within the housing and adapted to control fluid flow through the at least one flow port;

a first pressure transducer located upstream from the at least one flow port; and a second pressure transducer located downstream from the at least one flow port, whereby the first and second pressure transducers cooperate to report a pressure drop across the at least one flow port to the control panel.

7. The downhole fluid metering and control apparatus of claim 6, wherein the housing further includes an outer sleeve portion having a plurality of flow area control slots, the outer sleeve portion being disposed about the sleeve and across the flow ports.

8. The downhole fluid metering and control apparatus of claim 6, wherein the variable orifice valve includes a sleeve disposed for axial movement within a longitudinal bore of the housing to control fluid flow through the at least one flow port.

9. The downhole fluid metering and control apparatus of claim 8, wherein a lower end of the sleeve includes a stem for cooperating with a valve seat to sealably control fluid flow through the at least one flow port.

10. The downhole fluid metering and control apparatus of claim 9, wherein the stem is a carbide stem.

11. The downhole fluid metering and control apparatus of claim 8, further including a spring adapted to bias the sleeve to close the at least one flow port.

12. The downhole fluid metering and control apparatus of claim 8, further including a piston on the sleeve and in fluid communication with a source of hydraulic fluid and adapted to hydraulically control fluid flow through the at least one flow port.

13. The downhole fluid metering and control apparatus of claim 12, wherein the source of hydraulic fluid is a hydraulic control line provided in the communication conduit.

14. The downhole fluid metering and control apparatus of claim 12, wherein the source of hydraulic fluid is an on-board hydraulic system connected to the communication link and being controllable from the control panel.

15. The downhole fluid metering and control apparatus of claim 12, wherein the on-board hydraulic system includes a motor for driving a pump, the pump directing pressurized fluid to a solenoid valve, the solenoid valve directing the pressurized fluid to the piston to hydraulically control fluid flow through the at least one flow port.

16. The downhole fluid metering and control apparatus of claim 15, further including a first internal conduit, a second internal conduit, and a third internal conduit, the pump directing pressurized fluid through the first internal conduit to the solenoid valve, the solenoid valve directing the pressurized fluid through the second internal conduit to act on an upper side of the piston to move the variable orifice valve towards its closed position when the solenoid valve is in a first position, and the solenoid valve directing the pressurized fluid through the third internal conduit to act on a lower side of the piston to move the variable orifice valve away from its closed position when the solenoid valve is in a second position.

17. The downhole fluid metering and control apparatus of claim 15, wherein the solenoid valve is a shuttle-type solenoid valve.

18. The downhole fluid metering and control apparatus of claim 15, further including a volume compensator piston to displace the volume of fluid that is utilized as the apparatus operates and to compensate for pressure changes caused by any temperature fluctuations.

19. The downhole fluid metering and control apparatus of claim 14, further including at least one pressure transducer to report pressure in the hydraulic system to the control panel.

20. The downhole fluid metering and control apparatus of claim 8, further including a position sensor adapted to provide an indication of the position of the sleeve to the control panel.

21. The downhole fluid metering and control apparatus of claim 20, wherein the position sensor comprises position sensor rings that enable an operator at the earth's surface to control the flow rate through the apparatus by stopping the sleeve in at least one intermediate position between a full open and a full closed position.

22. The downhole fluid metering and control apparatus of claim 1, further including a straightener vane disposed within the housing adjacent the position sensor rings.

23. The downhole fluid metering and control apparatus of claim 1, wherein the variable orifice valve includes a sleeve disposed for axial movement within a longitudinal bore of the housing to control fluid flow through the at least one flow port.

24. The downhole fluid metering and control apparatus of claim 23, wherein a lower end of the sleeve includes a stem for cooperating with a valve seat to sealably control fluid flow through the at least one flow port.

25. The downhole fluid metering and control apparatus of claim 23, further including a spring adapted to bias the sleeve to close the at least one flow port.

26. The downhole fluid metering and control apparatus of claim 23, further including a piston on the sleeve and in fluid communication with a source of hydraulic fluid and adapted to hydraulically control fluid flow through the at least one flow port.

27. An apparatus for the downhole metering and control of fluids, comprising:

a housing connectable to a well tubing;

a communication conduit connected to the housing for communicating data collected within the apparatus to a control panel at the earth's surface;

a turbine meter disposed in the housing for providing an indication through the communication conduit to the control panel of a flow rate of well fluids through the housing; and a variable orifice valve disposed within the housing and adapted to control fluid flow through the housing wherein the apparatus is reversible so that it may be used alternatively to monitor production of fluids from a subterranean formation and to monitor fluids injected into the subterranean formation.

28. The downhole fluid metering and control apparatus of claim 27, wherein the housing further includes at least one flow port, and fluid flow through the at least one flow port is controlled by the variable orifice valve.

29. The downhole fluid metering and control apparatus of claim 28, further including a first pressure transducer located upstream from the at least one flow port, and a second pressure transducer located downstream from the at least one flow port, whereby the first and second pressure transducers cooperate to report a pressure drop across the at least one flow port to the control panel.

30. The downhole fluid metering and control apparatus of claim 28, wherein the housing further includes an outer sleeve portion having a plurality of flow area control slots, the outer sleeve portion being disposed about the sleeve and across the flow ports.

31. The downhole fluid metering and control apparatus of claim 28, wherein the variable orifice valve includes a sleeve disposed for axial movement within a longitudinal bore of the housing to control fluid flow through the at least one flow port.

32. The downhole fluid metering and control apparatus of claim 31, wherein a lower end of the sleeve includes a stem for cooperating with a valve seat to sealably control fluid flow through the at least one flow port.

33. The downhole fluid metering and control apparatus of claim 31, further including a spring adapted to bias the sleeve to close the at least one flow port.

34. The downhole fluid metering and control apparatus of claim 31, further including a piston on the sleeve and in fluid communication with a source of hydraulic fluid and adapted to hydraulically control fluid flow through the at least one flow port.

35. The downhole fluid metering and control apparatus of claim 34, wherein the source of hydraulic fluid is a hydraulic control line provided in the communication conduit.

36. The downhole fluid metering and control apparatus of claim 34, wherein the source of hydraulic fluid is an on-board hydraulic system connected to the communication link and being controllable from the control panel.

37. The downhole fluid metering and control apparatus of claim 36, wherein the onboard hydraulic system includes a motor for driving a pump, the pump directing pressurized fluid to a solenoid valve, the solenoid valve directing the pressurized fluid to the piston to hydraulically control fluid flow through the at least one flow port.

38. The downhole fluid metering and control apparatus of claim 37, further including a first internal conduit, a second internal conduit, and a third internal conduit, the pump directing pressurized fluid through the first internal conduit to the solenoid valve, the solenoid valve directing the pressurized fluid through the second internal conduit to act on an upper side of the piston to move the variable orifice valve towards its closed position when the solenoid valve is in a first position, and the solenoid valve directing the pressurized fluid through the third internal conduit to act on a lower side of the piston to move the variable orifice valve away from its closed position when the solenoid valve is in a second position.

39. The downhole fluid metering and control apparatus of claim 31, further including a position sensor adapted to provide an indication of the position of the sleeve to the control panel.

40. The downhole fluid metering and control apparatus of claim 27, wherein the turbine meter includes a turbine and a revolution counting device, the revolution counting device being connected to the communication conduit for providing an indication to the control panel, based upon the number of revolutions per unit time of the turbine, of flow rate of well fluids through the housing.

* * * * *